United States Patent [19]

Smith

[11] 4,052,576

[45] Oct. 4, 1977

[54] CONTACT STRUCTURE FOR $SF_6$ ARC SPINNER

[75] Inventor: Robert Kirkland Smith, Ambler, Pa.

[73] Assignee: I-T-E Imperial Corporation, Spring House, Pa.

[21] Appl. No.: 609,559

[22] Filed: Sept. 2, 1975

[51] Int. Cl.[2] ..... H01H 33/18

[52] U.S. Cl. ..... 200/147 R; 200/146 R; 200/148 B; 200/144 B

[58] Field of Search ..... 200/147 R, 144 R, 148 B, 200/148 G, 146 R

[56] References Cited

U.S. PATENT DOCUMENTS

| | | | |
|---|---|---|---|
| 1,827,940 | 10/1931 | Greenwood | 200/147 R |
| 2,140,378 | 12/1938 | Biersmanns et al. | 200/147 R |
| 3,210,505 | 10/1965 | Porter | 200/147 R |
| 3,551,625 | 12/1970 | Fischer | 200/147 R |
| 3,555,223 | 1/1971 | Robinson et al. | 200/144 B |
| 3,858,015 | 12/1974 | Deno | 200/148 R |
| 3,891,896 | 6/1975 | Clason | 200/147 R |
| 3,914,568 | 10/1975 | Crouch et al. | 200/144 B |

*Primary Examiner*—Robert S. Macon
*Attorney, Agent, or Firm*—Ostrolenk, Faber, Gerb & Soffen

[57] ABSTRACT

A single pressure sulfur hexafluoride circuit interrupter is contained in a bottle or elongated, cylindrical housing filled with gas under moderate pressure. The bottle contains arcing and main contacts arranged generally along the axis of the bottle and arranged to separate from one another in the vicinity of a pair of spaced, conductive rings fixed relative to one another, and which serve as arc runners. Each of the rings is connected in series with a respective coil which is wound on the axis of its respective ring and which encircles the cooperating contact and conductors therefor. The coils and the conductive rings create a magnetic field which spins an arc drawn between the spaced short-circuited rings through the sulfur hexafluoride gas, thereby to extinguish the arc. Each short-circuited ring and its respective coil are fixed relative to one another and are contained within a common insulation body in order to withstand the high electrodynamic forces created between the rings and coils during high current interruption. A small, low capacity puffer cylinder is connected to one of the moving contacts in order to produce at least a limited amount of gas motion through the arc space between the open contacts and the fixed rings when the contacts separate. The arcing contacts are arranged to have a blow-off path directed to cause an arc drawn between the contacts to transfer to the spaced conductive rings. In one embodiment of the invention, only a single coil is used to produce a magnetic field for spinning the arc between the spaced rings. The interrupter structure is useful in connection with a vacuum dielectric medium. Other embodiments of the invention show different forms of arcing contacts and different arrangements for introducing the spaced conductive rings into the circuit during interruption conditions. In another embodiment of the invention, a single conductive ring with a single coil cooperates with the movable contact. In still another embodiment of the invention, the conductive rings which form a gap within which the arc is circulated also serve as movable arcing contacts and are movable relative to one another.

17 Claims, 16 Drawing Figures

FIG. 1.
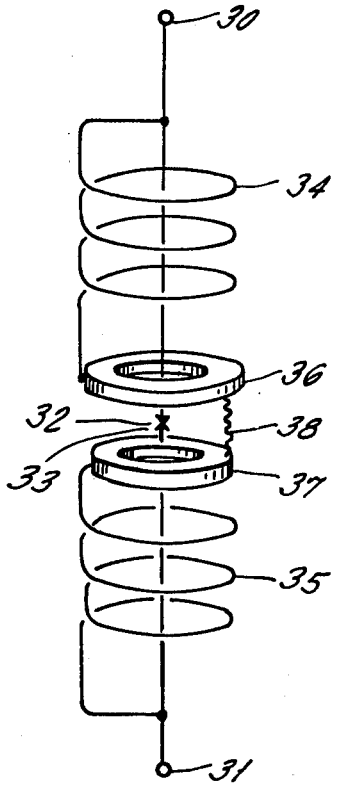
FIG. 2.
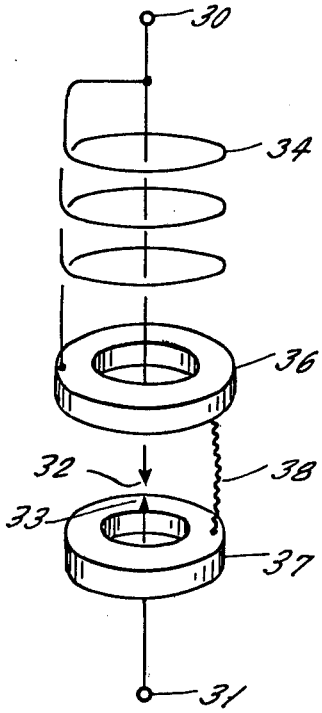
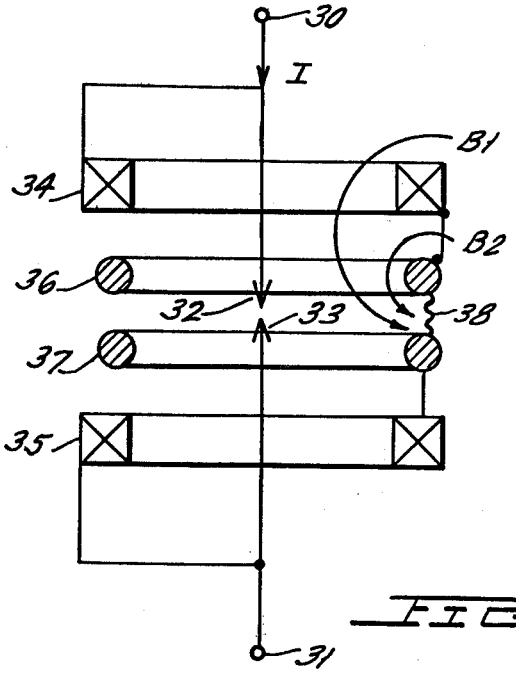
FIG. 1a.
FIG. 1b.
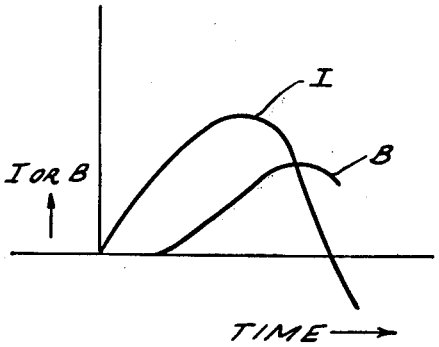

OPERATING MECHANISM
96
96a
31
41
95
42
70
71
72
73
80
85
75
76
74
78
81
84
93
90
100
77
94
83
91
50
51
52
48
61
82
62
49
47
60
45
44
46
30
40
5
6
7

OPERATING MECHANISM
96
95
70
71
72
73
42
110
111a
78
76
74
75
77
116
9
9
52
50
51
111
123
124
49
48
120
115
47
122
118
44
45
46
30

96
OPERATING MECHANISM
96a
31
95
70
71
72
73
150
150b
78
76
74
75
166
160
167
164
77
155
162
161
154
50
51
52
165
163
40
49
47
152
151
150a
153
45
44
46

CONTACT STRUCTURE FOR $SF_6$ ARC SPINNER

RELATED APPLICATIONS

This application is related to copending application Ser. No. 609,231, filed Sept. 2, 1975, in the name of G. A. Votta, entitled MAGNETICALLY DRIVEN RING ARC RUNNER FOR CIRCUIT INTERRUPTER; copending application Ser. No. 609,161, filed Aug. 29, 1975, in the name of D. E. Weston, entitled HYBRID POWER CIRCUIT BREAKER; and copending application Ser. No. 609,160, filed Aug. 29, 1975, in the name of D. E. Weston, entitled $SF_6$ PUFFER FOR ARC SPINNER, all of which are assigned to the assignee of the present invention.

BACKGROUND OF THE INVENTION

This invention relates to circuit interrupters, and more specifically relates to a novel, single-pressure bottle type interrupter which is filled with a relatively static dielectric gas or medium wherein arc interruption is obtained by rotating the arc through the relatively static gas.

The novel interrupter of the present invention has application over a wide range of voltage and current ratings and is particularly applicable to relatively high voltage ratings, such as 15 kV and above. At the present time, a variety of different types of interrupters and circuit breakers are used for interruption of high voltage circuits, but each of these are relatively expensive and have numerous operational disadvantages. For example, vacuum interrupters and air magnetic interrupters are frequently used in connection with 15 kV and 38 kV metalclad switchgear circuits. The air magnetic interrupter is old and well known and is large and expensive and requires frequent maintenance. In the air magnetic interrupter, a pair of contacts separate and the arc drawn between the contacts is transferred to respective arc runners which guide the arc into an arc chute, where the arc can be cooled and deionized and extinguished. Some air magnetic circuit interrupters are also provided with a small puffer arrangement, whereby an air stream flows through the arc to assist its movement into the arc chute. The concept of transferring an arc from a pair of separating contacts and guiding the motion of the arc by means of arc runners will be seen hereinafter to be employed conceptually in the present invention. In addition, the concept of a limited puffer will also be seen hereinafter to be employed with the present invention.

Vacuum interrupters are also well known, but these are expensive and are subject to breakdown following an interruption action. Vacuum interrupters moreover cause "chopping" during interruption on some circuits and can produce high voltage on those circuits. Vacuum interrupters frequently employ an arrangement which causes the arc drawn between the separating contacts to spin around the contacts, thereby to more evenly distribute the heat created by the arc on any localized area of the contact. As will be seen hereinafter, the present invention employs the general concept of arc spinning, although this is done in a totally different context in the present invention.

Bulk oil breakers are well known for applications, for example, in 15 kV ranges and above, but bulk oil breakers again are large and are expensive. The bulk oil breaker employs the concept of drawing an arc between separating contact is in a relatively high dielectric medium and also employs the concept of generating high-pressure gases which blast through the relatively stationary arc. As will be seen hereinafter, the concept of a relatively high dielectric medium is employed with the present invention but in a different context than used in the bulk oil breaker.

At higher voltages, for example, 121 kV and above, various interrupting mediums have been used to interrupt an arc including oil and air blast. Such breakers are large and expensive and create periodic maintenance. Two-pressure sulfur hexafluoride breakers are also used at these higher voltages, but the two-pressure breaker is again large and complex and requires equipment for maintaining relatively high gas pressures. The concept of the air blast breaker, like the oil breaker, relies on the high speed movement of a dielectric fluid through a relatively stationary arc in order to cool and extinguish the arc. A similar concept is employed in the two-pressure $SF_6$ interrupter wherein a relatively high speed movement of $SF_6$ through a relatively stationary arc permits the extinguishing of the arc. The present invention employs the general concept of relative movement of an arc with respect to a dielectric fluid.

Puffer type circuit breakers are also used in relatively high voltage ranges where the movement of the contacts causes a rapid flow of gas which moves through a relatively stationary arc in order to extinguish the arc. Breakers of this type are large and require considerable operating power in order to move the pressure-generating equipment and become complex ane expensive and require periodic maintenance. The puffer breaker, like the two-pressure $SF_6$ breaker, relies on a high speed blast of dielectric fluid, such as sulfur hexafluoride gas, through a relatively stationary arc in order to extinguish the arc.

The novel circuit interrupter of the present invention can be used in place of the above type circuit interrupters of the prior art as well as others not mentioned above over a wide range of rated voltages and over a wide range of continuous current and interrupting current ratings.

In a specific application, the device of the present invention is a hermetically sealed bottle interrupter that can replace presently available vacuum bottle interrupters for 15.5 and 38 kV power circuit breakers. In another aspect of the invention, structures are provided which can be employed with a vacuum, as well as a gas dielectric medium.

The novel sealed bottle interrupter of the invention may also be used in combination with and in series with a vacuum interrupter, or with another gas-filled bottle, to form a high voltage, high capacity power circuit breaker, as disclosed in copending application Ser. No. 609,161, filed Aug. 29, 1975, referred to previously. When used in that manner, for a so-called hybrid circuit breaker, the dielectric recovery capability and dielectric withstand capability of the dielectric gas-filled bottle of this application cooperates synergistically with the interruption and thermal recovery characteristics of the vacuum or other interrupter.

BRIEF DESCRIPTION OF THE PRESENT INVENTION

The basic principle of the interrupters of the present invention is to employ the concept of rotation of a short controlled arc through a relatively static sulfur hexafluoride gas (or some other dielectric medium) in order to cool, deionize and extinguish the arc and thus open a circuit which is being protected.

The high speed continuous rotation of an arc in a gas medium as a means for interruption of current flow involves principles of interruption quite different from those of conventional $SF_6$, air or oil interrupters. Thus, each dielectric medium has some inherent capability for interrupting up to a particular magnitude of current with a particular recovery voltage when a stationary arc is drawn in a relatively static volume of that medium. In pure $SF_6$, that current might be about 100 amperes.

By causing the arc to rotate through the gas as in the present invention, the arc current magnitude will pass through an instantaneous current value of 100 amperes as the arc current approaches zero and, since the arc constantly rotates, it will always be moving in relatively clean gas generally equivalent to the situation that would exist if a stationary arc had been drawn in a static gas volume. The relative velocity of the arc relative to the gas is believed to be equal to or greater than the sonic velocity of gas through the nozzle of a conventional puffer breaker containing a stationary arc. Thus, all thermal history of the arc, both for the dielectric medium and the spaced ring-shaped electrodes, can be effectively distributed into the volume of the dielectric medium and the mass of the electrodes, which are made sufficiently large that no residual thermal effects remain during the time the current decreases from 100 amperes to zero.

By having a short arc length, by virtue of close spacing between the ring-shaped electrodes, there will be a relatively low thermal input to the dielectric medium during arcing. Moreover, close spacing of relatively massive, ring-shaped arcing electrodes provides a good thermal sink to conduct energy from the gap at the time of current zero.

A result of this novel, critical spacing between the ring-shaped electrodes is a rapid recovery of the dielectric strength of the medium after interruption at current zero, so that it can withstand transient recovery voltages.

Arc movement through the gas at relatively low current levels is ensured by providing a winding in series with at least one of the ring-shaped electrodes, so that the current being interrupted flows through the winding. The mutual coupling between the winding and the closed arcing ring induces current flow in the ring since it is a short-circuited winding. The resultant magnetic field of the current flow through the coil and the induced current in the ring creates a magnetic field through the gap between the spaced, conductive rings which is out of phase with the current being interrupted and which has a sufficient magnitude near current zero to ensure rotational movement of the arc current through the static gas or other interrupting medium, such as vacuum, filling the bottle.

The broad concept of moving an arc through a gas in order to assist in the interruption of the arc and the use of conductive rings associated with windings in series with the circuit to be interrupted for providing a magnetic field to rotate the arc is shown in the following publications: "Elektromagnitnoe gashenie dugi v elegaze" by A. I. Poltev, O. V. Petinov and G. D. Markush, from "Elektrichestvo," No. 3 (1967), pages 59–63; "Untersuchungen am rotierenden Schaltlichtbogen in Schwefelhexafluorid" by D. Markusch, from "Elektrie" No. 10 (1967), pages 364–67; and "Elegas circuit-breakers for 35–110 KV" by A. I. Poltev, from "Elektrotekhnika," No. 8 (1964).

The present invention provides numerous features which are not suggested in the above references but which allow the use of the concept of the publications in a practical circuit interrupter.

A first important aspect of the present invention involves the recognition of the need for relatively close spacing between the spaced stationary conductive rings which define an infinite arc runner. By way of example, the rings of the present invention, which may have an inner diameter of about 2 inches, an outer diameter of about 4 inches and a thickness of about one-fourth inch, are spaced from one another by about one-half inch or more, up to about 2 inches. By spacing the contacts this close and by making the rings relatively massive members, only a small amount of gas is instantaneously exposed to the arc and the total gas volume within the bottle is not greatly heated by the arc. The relatively massive conductive disks will act as extremely efficient heat sinks to conduct away localized heat created by the arc and its arc roots. Moreover, the arcing rings are made of copper as contrasted to a conventional arcing material such as copper-tungsten since relatively pure copper will allow easier motion of the arc root along its surface and thus will permit a higher velocity for the arc as it moves through the dielectric gas within the bottle. That is to say, conventional arc-resistant materials which one skilled in the art would normally select for a component subjected to an arc, such as copper-tungsten, produce a thermionic arc which is relatively difficult to move and requires relatively large amounts of energy for moving the arc along the material surface. Copper, on the other hand, which is used in accordance with the present invention, is a field-emitting material wherein the arc roots can be moved with small expenditure of energy.

The present invention also recognizes that extremely large electrodynamic forces are created between the winding which carries the current to be interrupted and which assists in the production of a magnetic field for rotating the arc and the closely coupled short-circuited ring. These electrodynamic forces have been so great that the apparatus tends to become self-destructive at fairly modest interrupting currents.

Therefore, in accordance with another important aspect of the invention, the two coils are mounted by potting in a common insulation housing, which may be an epoxy type material or a glass fibre reinforced plastic material, so that it can contain the tremendous repulsion forces created between the two windings during high current fault conditions.

A further important aspect of the present invention involves the incorporation of a small puffer arrangement for causing a relatively small gas movement through the space between the conductive arcing rings or arcing runners. As was pointed out previously, gas puffers are old and well known where, however, the puffer arrangement is used in combination with contacts that create a relatively stationary arc, whereby the motion of the gas through the arc affects its extinction.

The present invention employs the different concept of a relatively stationary gas and a movable arc for creating relative movement between the arc and the gas.

In accordance with another feature of the invention and even though the arc is moved relative to the gas, a small amount of gas movement is provided to assist in interruption of the arc in a current band where the current to be interrupted is insufficiently high to produce a strong enough magnetic field to move the arc at sufficient velocity to cause its effective interruption between the open contacts and the stationary arc runners, but is not low enough to be interrupted as a static arc in the static gas. In this situation, a modest movement of the gas relative to the arc (as compared to the massive movement of gas in a puffer type interrupter) will permit easy and effective interruption of the current in this small band so that the overall interrupter can now be used throughout a wide band of possible interruption current conditions.

Still another feature of the present invention is the novel provision of arcing and main contacts which extend along the axis of the bottle and which extend through and coaxially with the spaced arcing rings and the windings associated therewith.

These contacts provide the necessary continuous and momentary capability needed for the device, and also define an initial arcing path designed to strike an arc upon breaker opening and to transfer this arc to the circular arc runner attached to the field producing winding. Thus, contacts are further arranged to produce a magnetic blow-off path such that, as the arcing contacts open, the arc drawn between the arcing contacts is blown onto the fixed, spaced conductive rings which will receive the arc and have the arc rooted therearound in order to finally extinguish the arc.

The windings or magnetic coils should not be part of the continuous current path since they represent inductance and produce repelling forces on each other. Thus, an auxiliary contact structure is needed to carry continuous current. This structure must also open to strike an arc and cause the arc to be transferred to the rings of the interrupter. This means commutating current from one path to another path which contains inductance. This task requires a driving voltage, supplied by the arc struck between the auxiliary contacts, to cause the current commutation. Moreover, it requires the initiation of an arc involving one or both rings to provide a complete current path through one or both coils into which the short-circuit current is commutated. The structures described in this application are designed to accomplish these goals.

The present invention also incorporates a noval arrangement for the arcing contacts, whereby the arcing contacts serve as the spaced rings when the arcing contacts are open and form a gap around which the arc is circulated.

In yet another embodiment of the invention, a single conductive ring and winding therefor cooperate with extensions from the movable contact, whereby an arc will be initiated between the conductive ring and the center contact and will rotate between these members under the influence of the magnetic fields produced by the circulating current in the short-circuited ring and the magnetic field of its respective coil.

BRIEF DESCRIPTION OF THE DRAWINGS

FIG. 1 is a schematic drawing of a circuit interrupter employing fixed, spaced conductive rings which serve as infinite arc runners with magnetic field-producing coils for each of the conductive rings.

FIG. 1*a* is a schematic cross-sectional view of the arrangement of FIG. 1 to illustrate the production of a magnetic flux between the fixed spaced rings in order to cause the arc between the rings to rotate rapidly around the space between the rings.

FIG. 1*b* is a graph which illustrates the arc current and the magnetic field in the arrangement of FIGS. 1 and 1*a*, and illustrates the presence of a magnetic field for moving the arc at the critical time while the arc current is decreasing toward zero.

FIG. 2 shows an arrangement similar to that of FIG. 1 where, however, only a single magnetic field-producing coil is used for the two fixed, spaced conductive rings.

DETAILED DESCRIPTION OF THE DRAWINGS

Figure 3:
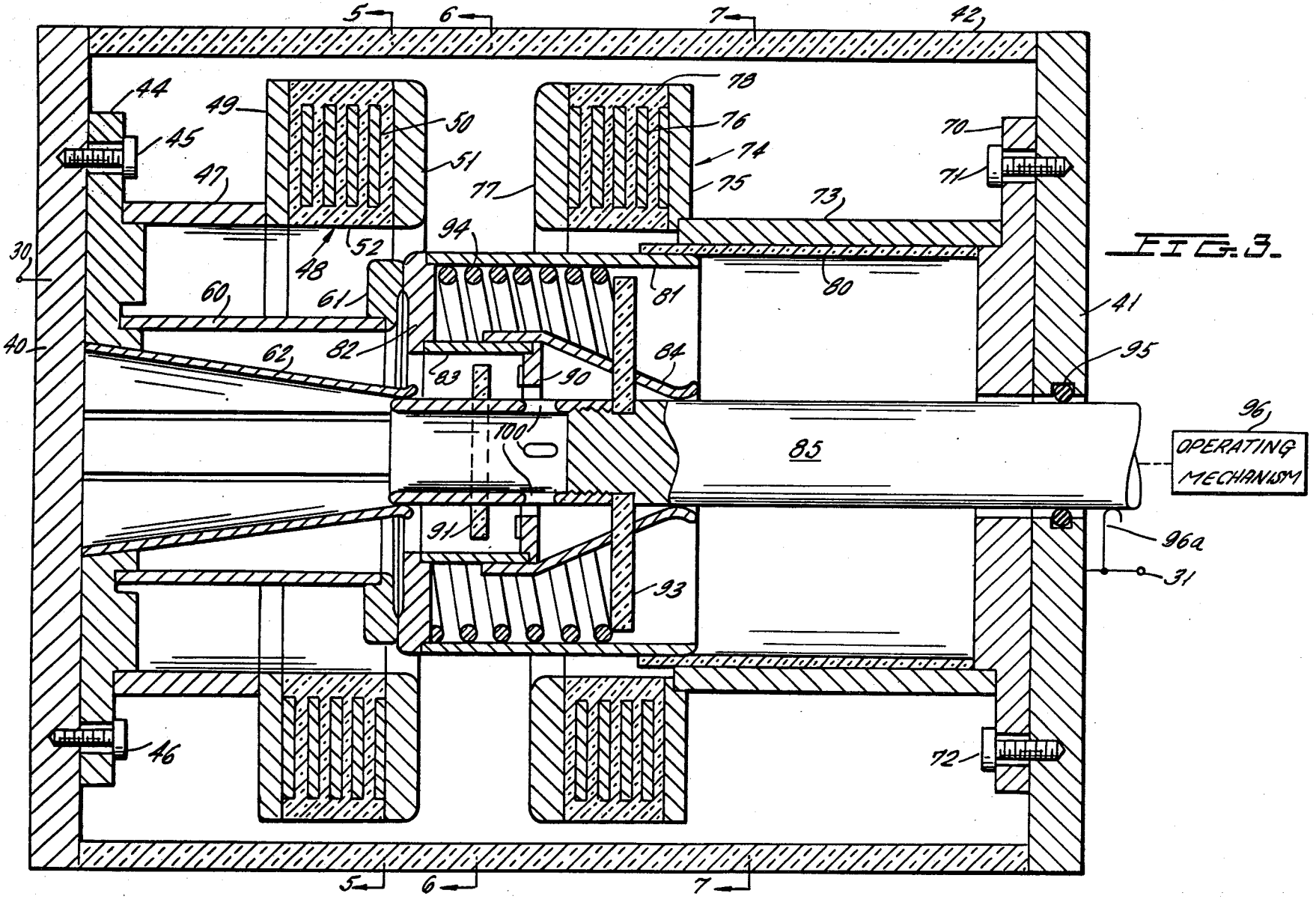
FIG. 3 is a cross-sectional view taken through the axis of a bottle interrupter constructed in accordance with the invention and shows the interrupter contacts and main contacts in their closed position.

Referring first to FIG. 1, there is schematically illustrated therein an arrangement for a circuit interrupter for opening the circuit between terminals 30 and 31. The circuit includes a pair of interrupter contacts schematically shown as interrupter contacts 32 and 33, respectively, which are connected to terminals 30 and 31, respectively. The conductors connecting terminals 30 and 31 to contacts 32 and 33, respectively, pass through multi-turn stationary windings 34 and 35, respectively, and fixed conductive copper rings 36 and 37, respectively. It will be noted that in the arrangement of FIG. 2 that the coil 35 has been removed in order to simplify the construction necessary for the interrupter by reducing the number of parts therefor. The coil 34 is then electrically connected to terminal 30 at one end to the conductive ring 36 at its other end. Similarly, the coil 35 is connected to terminal 31 at one end and to ring 37 at its other end.

When the contacts 32 and 33 are closed, a circuit is formed directly between terminals 30 and 31. When, however, the contacts 32 and 33 open, an arc is drawn between them and this arc, as will be seen hereinafter in the more detailed embodiments of the invention, is transferred to the spaced stationary rings 36 and 37. An arc 38 is schematically illustrated between rings 36 and 37.

The entire assembly of FIG. 1 (and of FIG. 2) is contained within a bottle or suitable sealed housing filled with some suitable dielectric medium, such as sulfur hexafluoride gas at atmospheric pressure or at elevated pressure. This bottle is not shown in FIGS. 1 and 2, but will be described later in connection with FIGS. 3 to 7. Note that any desired dielectric gas could be used and, indeed, the interrupting medium could be air if the interrupter is to be used at relatively low voltages. Preferably, however, the dielectric medium will be sulfur hexafluoride or some other well-known electronegative gases or some mixture of an electronegative gas with some other dielectric gas, and also may be a vacuum.

The arrangements shown in FIGS. 1 and 2 will cause the arc 38 to rotate very rapidly around the rings 36 and 37. This rotation is caused by a radial magnetic field which is produced by the windings 34 and 35 and by the circulating current induced in rings 36 and 37. This is shown best in FIG. 1, for example, where a magnetic field $B_1$ associated with winding 34 passes through the gap between rings 36 and 37, whereby a force is produced on the arc current 38 which tends to cause it to rotate around the circular gap defined between rings 36 and 37. The magnetic field $B_1$ will also induce a circulating current in the rings 36 and 37 (which act as short-circuited turns) and this short-circuit current will give rise to a second magnetic field $B_2$ shown in FIG. 1*a*. The field $B_2$ will have a phase relationship with the field $B_1$ such that the fields oppose one another as the current I to be interrupted increases and will be additive as the current I decreases. Consequently, as shown in FIG. 1*b*, a resultant magnetic field B will be present in the vicinity of the arc 38 when the current I is decreasing toward current zero so that a substantial force is applied to the arc current 38 to cause it to move through the static dielectric gas in the gap between rings 36 and 37 as the current decreases toward zero. The arc current 38 is then extinguished as it passes through a current zero. Note that, in the absence of the phase shift which causes the field B to be relatively large toward the end of the current cycle, the driving force on the arc would decrease rapidly with the current so that the arc does not move rapidly enough to extinguish the arc as the arc current approaches zero current.

It has been previously thought necessary to use respective coils 34 and 35 with the spaced short-circuited rings 36 and 37.

FIG. 2, however, illustrates an arrangement whereby only a single coil 34 is used, where the coil 34 will produce the results shown in FIGS. 1*a* and 1*b* to ensure rapid rotation of the arc current 38 as the current approaches current zero. The elimination of the further coil associated with ring 37 produces substantial simplification and reduction in cost in the construction of an actual interrupter.

FIGS. 3 to 7 illustrate an embodiment of the invention in a circuit interrupter and illustrate the incorporation therein of a number of important features necessary to the successful operation of the interrupter.

Referring not to FIGS. 3 to 7, it will be understood that the illustration of the interrupter therein is shown in schematic form.

The housing or bottle for the interrupter consists of spaced conductive end plates 40 and 41 which are connected to terminals 30 and 31 (as in FIG. 1) and which receive and are supported at the opposite ends of an epoxy or ceramic cylinder 42. The ends of cylinder 42 may be secured to the end plates 40 and 41 in any desired sealed manner. The interior of the bottle is then filled withany desired dielectric medium, such as sulfur hexafluoride gas, at a pressure, for example, of 15 p.s.i.g. or greater. Generally, a higher pressure is desired at the higher voltage ratings.

End plate 40 then has a conductive disk 44 bolted thereto as by a bolt ring which includes bolts 45 and 46 and the conductive disk 44 then has a short copper tube 47 brazed or otherwise secured thereto to support a first composite ring 48. The composite ring 48 consists of a disk 49 which is welded or brazed to the right-hand end of cylinder 47, a helical winding 50 (which corresponds to winding 34 of FIG. 1) and the first fixed conductive ring 51 which corresponds to conductive ring 36 of FIG. 1.

Note that the disk 49 may contain axial slots therein (not shown) in order to prevent the formation of a short-circuited turn and the circulation of current induced from the winding 50. Similarly, conductive cylinder 47 may be slotted to prevent its appearance as a short-circuited turn.

The winding 50 is shown as a pancake type winding with one of its ends fixed to disk 49 and the other of its ends fixed to ring 51. Winding 50 can also be cylindrically oriented if desired.

The ring 51, winding 50 and disk 49 are made as a unitary ring structure and are fixed together by potting in an epoxy or glass fibre reinforced medium 42. This arrangement then gives extremely close magnetic coupling between winding 50 and ring 51 so that relatively high current can be induced in the ring 51, thereby to increase the magnetic field which is ultimately produced for rotating the arc which is to be extinguished by the apparatus as will be later described. The novel assembly of the composite ring 48 also provides a high-strength arrangement capable of withstanding the extremely large electrodynamic repulsion force produced between the winding 50 and the short-circuited ring 51 under high current conditions.

The conductive disk or support member 44 next receives a conductive tube 60 which is terminated by an arcing contact ring 61 which is brazed or otherwise secured to the end of tube 60. This constitutes a contacting arrangement equivalent to the arcing contact 32 of FIG. 1. If desired, contact ring 61 may have individually axially extending contact fingers extending from a ring-shaped hub.

In the embodiment of FIGS. 4 to 7, a further parallel contact arrangement is provided which serves as the main contact for the interrupter and consists of the segmented tubular contact 62 which is fastened at one end to the pad or conductive member 44 in any desired manner.

It will be noted that all of the components described above including the composite ring 48, the arcing contact 61 and the main contact 62 are all supported ultimately from end plate 40 and may be assembled with plate 40 before the interrupter bottle is closed.

The cooperating interrupter components are supported on the other end plate 41 and, more particularly, on a conductive plate 70 which is bolted to the end plate 41 by bolts 71 and 72 of a suitable bolt ring. A conductive tube 73 is then suitably secured to the plate 70 and supports a fixed composite ring 74 which is identical in construction to the composite ring 48 and which contains a support backplate 75, a winding 76 and a conductive ring 77. Note that winding 76 and ring 77 correspond to winding 35 and ring 37 of FIG. 1.

The composite ring 74 is held together by an epoxy body 78 similar to the epoxy body 52 of the composite ring 48. The two surfaces of rings 51 and 77 thus face one another and are fixed relative to one another.

Typically, the rings are of copper and may be spaced by ½ to 2 inches, with an inner diameter of 2 to 4 inches and an outer diameter of 4 to 6 inches, and an axial thickness of from ⅛ to 5/16 inches. Other dimensions can be used if desired to meet particular ratings.

In the manufacture of backplate 75 and tube 73, suitable slots may be used and might prevent the formation of a short-circuited turn which could drain energy from the winding 76 during the operation of the interrupter.

The interior of copper tube 73 receives a tube 80 of insulation material, such as polytetrafluoroethylene (Teflon) which is suitably fixed inside of tube 73. The tube 80 then slidably receives a piston 81 formed by a conductive cylinder which has an arcing contact disk 82 across the outer left-hand end thereof. The arcing contact disk 82 cooperates with the arcing contact ring 61 and these arcing contacts may be of copper or of a conventional arcing material such as copper-tungsten or the like. It may be preferable to use copper since it will enhance the transfer of the arc from the arcing contacts to the arcing rings.

The interior diameter of disk 82 then receives a conductive ring 83 as by brazing or the like and a plurality of spaced contact fingers 84 are fastened to and are electrically connected to the cylinder 83. These contact fingers 84 are in slidable electrical connection with the outer surface of the main moving contact 85 which will be later described.

The right-hand end of conductive tube 83 also has a disk 90 extending therefrom which cooperates with an extension 91 on the movable contact rod 85 in order to operate the gas puffer piston as will be later described. Contact rod 85 also has a spring support spider 93 extending therefrom which captures a compression spring 94 against the right-hand surface of interrupter contact disk 82.

Figure 4:
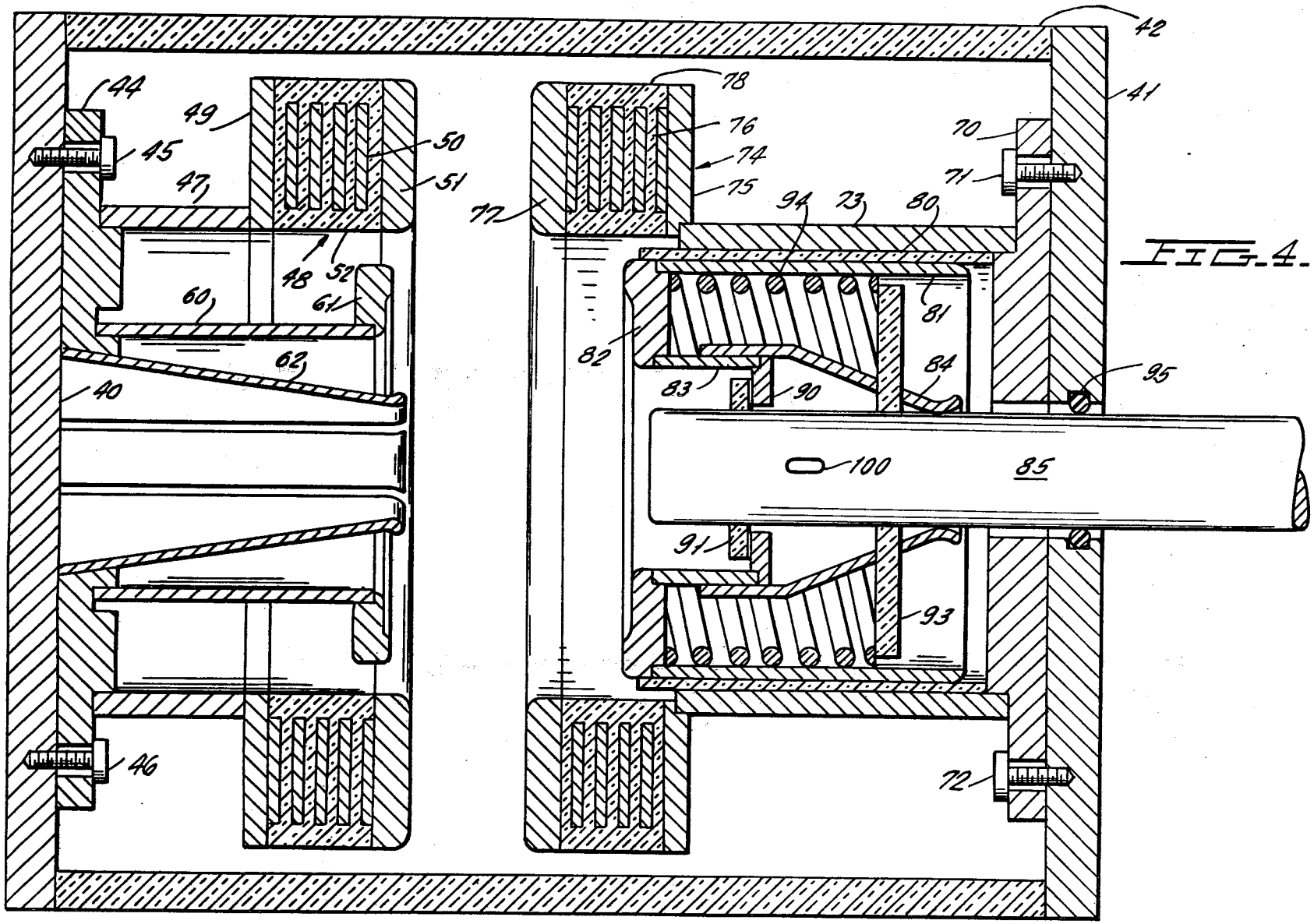
FIG. 4 is a cross-sectional view similar to that of FIG. 3, but shows the contacts in their open position.
Figure 5:
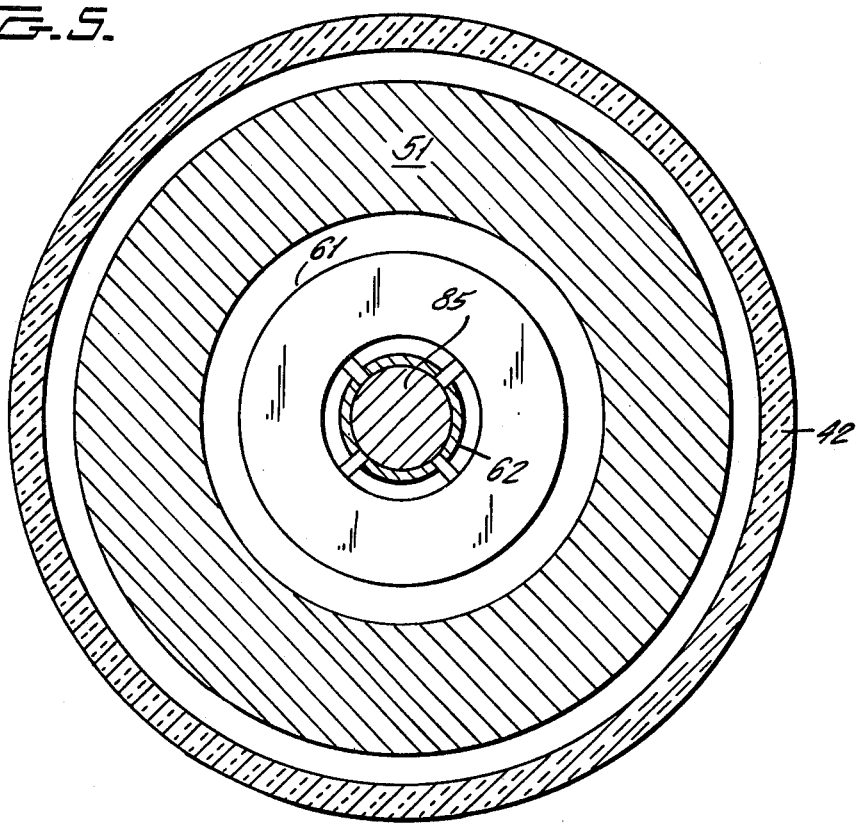
FIG. 5 is a cross-sectional view of FIG. 3 taken across the section lines 5 — 5 of FIG. 3.
Figure 6:
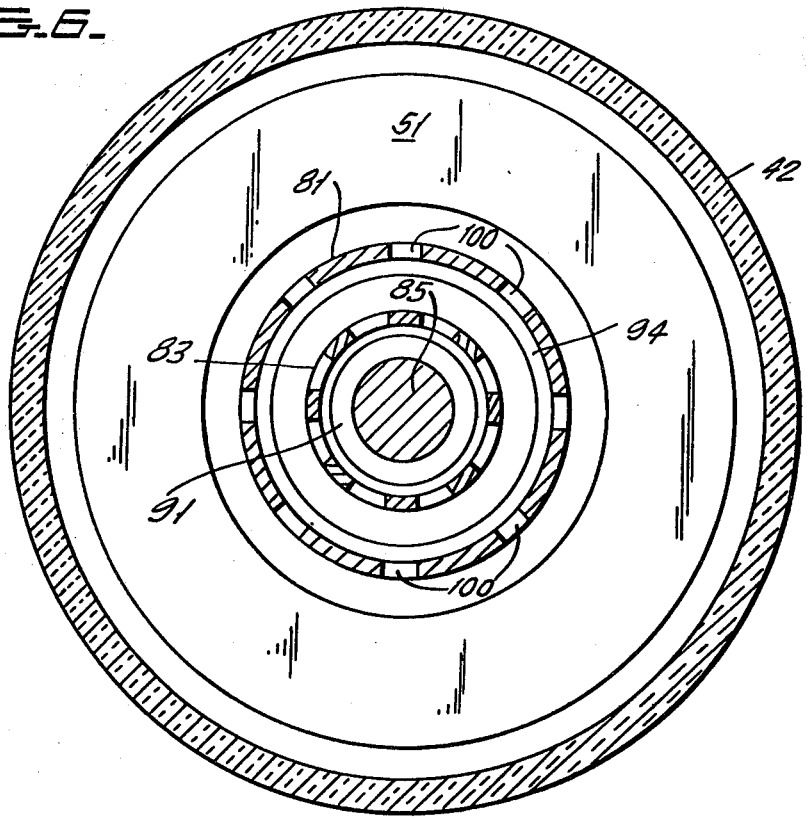
FIG. 6 is a cross-sectional view of FIG. 3 taken across the section lines 6 — 6 in FIG. 3.
Figure 7:
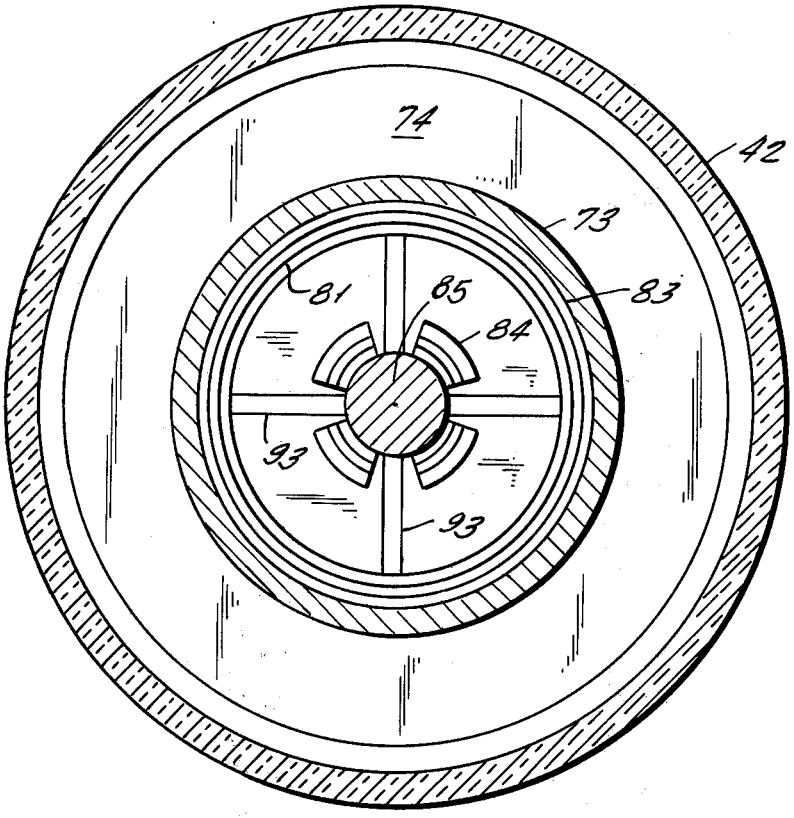
FIG. 7 is a cross-sectional view of FIG. 3 taken across the section lines 7 — 7 in FIG. 3.

The main moving contact rod 85 enters the interrupter bottle through the gas seal 95, or suitable bellows or the like, and is connected to a suitable operating mechanism 96 which moves the main moving contact in an axial direction and between its closed position of FIG. 3 and open position of FIG. 4.

The operation of the interrupter of FIGS. 3 to 7 is as follows:

When the interrupter is in its closed position, shown in FIG. 3, current flow proceeds from terminal 30, into plate 40, through main contact segment 62, into the main moving contact 85 to the terminal 31. Note that a sliding contact, schematically illustrated as sliding contact 96*a*, connects main contact 85 to the terminal 31 and to the plate 41.

When the main contacts are closed, most of the current flows through the main contacts and relatively little current flow takes place through the arcing contacts 61 and 82 because of their relatively high resistance contact compared to the low resistance of the main contacts.

In order to open the interrupter due either to a manual operation or an automatic operation initiated in response to a fault condition, the operating mechanism 96 causes the main moving contact 85 to move to the right and from the position of FIG. 3 toward the position of FIG. 4.

The end of the movable contact rod 85 will first separate from the main contact 62 and the current through the main contacts will commutate into the arcing contacts 61 and 82. Note that the arcing contacts 61 and 82 remain closed under the influence of spring 94 until the main movable contact has moved sufficiently far that the extension on the main contact rod 85 engages extension 90 on the tube 83. The current path for the current through arcing contacts 61 and 82 now includes tube 60, contact 61, contact 82, sliding contact fingers 84 and the contact rod 85.

Once extension 91 engages extension 90, the continued movement of main contact rod 85 to the right will cause arcing contact 82 to move to the right and will cause the initiation of an arc between arcing contacts 61 and 82. It will be noted that the current path taken by the current through the arcing contacts is a reentrant path having a general U shape in cross-section. As is well known, a path of this shape will apply a blow-off force to the current so that the arc current between arcing contacts 61 and 82 tends to move outwardly and away from the base of the U. Thus, the arc drawn between arcing contacts 61 and 82 will tend to expand radially outwardly away from the axis of the bottle and the arc roots will ultimately be transferred to conductive rings 51 and 77.

The current path through the interrupter then includes conductive tube 44, conductive ring 49, coil 50, ring 51, the current ring 77, coil 76, conductor 75, tube 73 and conductive plates 70 and 41 and thence terminal 31. The arc current between rings 51 and 77 is subjected to a magnetic field which will tend to cause the arc to rotate or spin around the axis of the bottle and through the relatively static gas within the bottle as was described in connection with FIGS. 1, 1*a* and 1*b*, whereby the arc is extinguished and the circuit between terminals 30 and 31 is open.

It should be specifically noted that the cylinder 81 and arcing contact 82 define the movable piston of a puffer type arrangement which moves with respect to a cylinder 80. Thus, as the arcing contact 82 moves to the right in its motion to a disengaged position, it also compresses the gas within the interior of members 80 and 81.

Slots 100, located in contact 85, permit discharge of the gas toward the gap between arcing contacts 82 and 61. This then produces a relatively small gas blast action which permits the interruption of relatively low currents which might not otherwise be moving rapidly enough within the dielectric gas to be effectively interrupted. That is, a low current would create a relatively stationary or fixed arc on the arcing contacts 61 and 82.

It will be noted that the sequence of operation of the contacts of the interrupter is such that the main contacts are not subjected to any arcing duty so that its contacting surfaces remain clean and unpitted.

In reclosing the breaker, the opposite sequence from that described above will occur, whereby contact rod 85 is moved to the left. The interrupter contacts 61 and 82 will be the first to touch and thus will take the burden of in-rush current conditions. Thereafter, the main contacts 62 and 85 will engage under substantially arc-less conditions and the interrupter is again in service.

Figure 9:
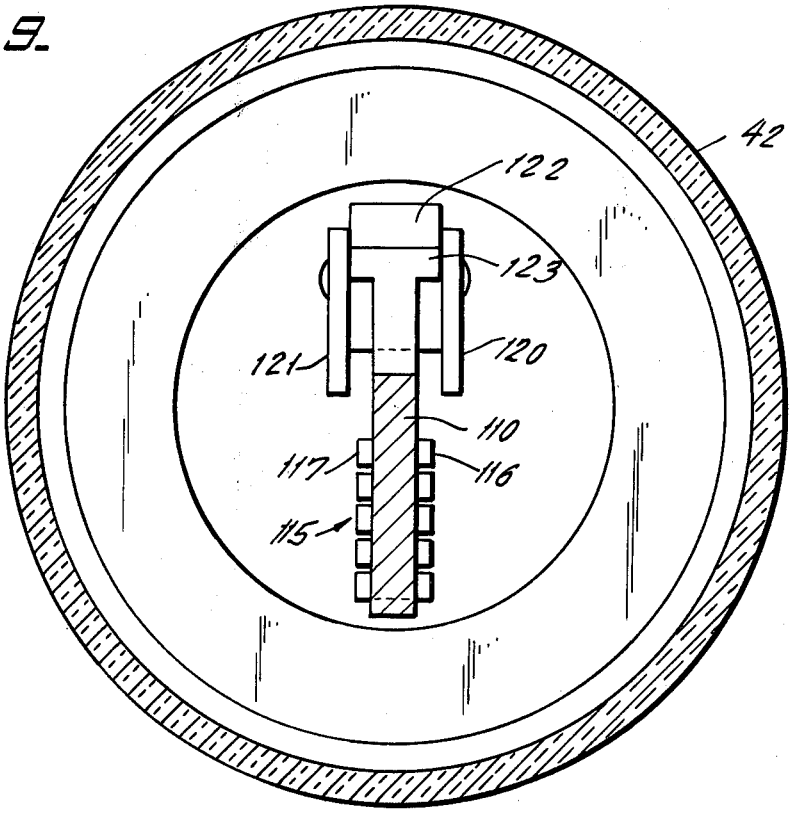
FIG. 9 is a cross-sectional view of FIG. 8 when taken across the section lines 9 — 9 in FIG. 8.
Figure 8:
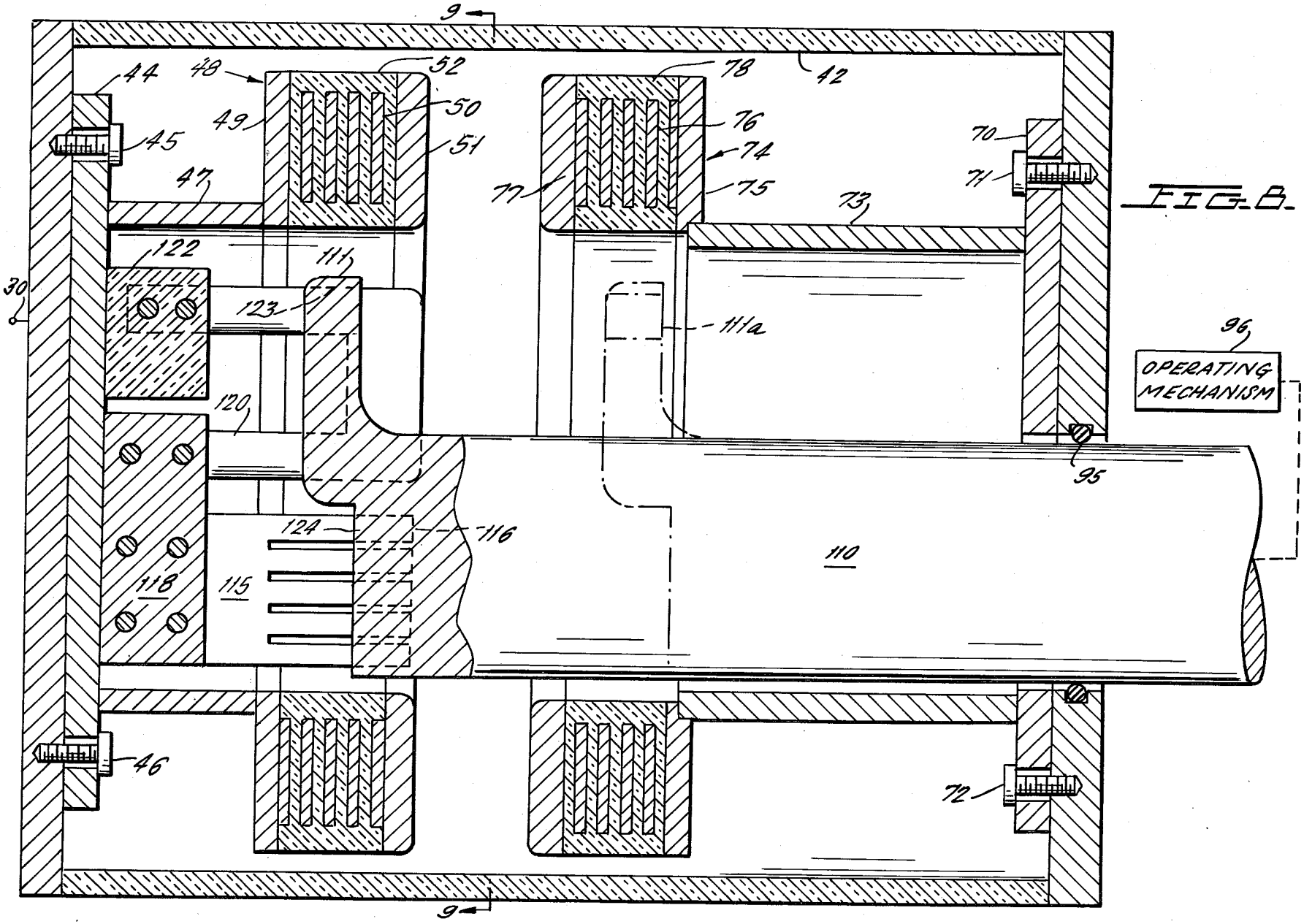
FIG. 8 is a cross-sectional view taken through the axis of a bottle interrupter which has a modified construction for the arcing and main contacts.

Referring next to FIGS. 8 and 9, there is shown therein a circuit interrupter similar to that of FIGS. 3 to 7 wherein components similar to those of FIGS. 3 to 7 have been similar identifying numerals.

In the arrangement of FIGS. 8 and 9, the main movable contact 110 has an upturned arcing end portion 111. The contact 110 may be circular in cross-section as it passes through the ring 95 if desired, and is blade-shaped at its left-hand end. The position of the movable contact 110 is shown closed in solid lines and is shown withdrawn to a dotted-line position 111*a* to illustrate the contact in its open condition.

The stationary contact structure consists of a jaw-type contact 115 having separate finger elements including finger elements 116 and 117 (FIG. 9) where the jaw contact 115 is secured to a suitable plate 118 connected to the conductive plate 44. Plate 118 further supports a pair of contact members 120 and 121 which are generally U-shaped in configuration and terminate on the opposite sides of an insulation support element 122. It will be noted that the contact extension 111 of the main contact 110 has an enlarged width region 123 which spans the gap between contact members 120 and 121 so that it makes high-pressure engagement between contact members 120 and 121.

When the interrupter is closed and in the position shown in solid lines in FIG. 8, the bottom leading edge 124 of contact 110 serves as a blade which is engaged between the jaw-stationary contact 115. The arcing contact region 123 is also engaged deeply within the upper legs of arcing contact members 120 and 121.

In order to open the interrupter, the operating mechanism 96 moves the contact 110 to the right, thereby causing the edge 124 of contact 110 to disengage from the jaw contact 115. At this time, the interrupter contact 123 is still engaged between the contact members 120 and 121 and the current flow through the interrupter is transferred from the jaw 115 into the jaw-type interrupter contact members 120 and 121.

As the movable contact 110 continues to move to the right, the extension 111 is withdrawn from between contacts 120 and 121 and an arc is drawn between contact extension 111 and the contacts 120 and 121. The path taken by the current at this time is a sharp U-shaped path so that a strong magnetic blow-off force is exerted on the arc which causes the arc to transfer to the spaced rings 51 and 77, whereupon the arc rapidly spins in the gap between rings 51 and 77 under the influence of the magnetic fields which are produced as previously described.

In order to reclose the breaker, the above-described sequence is reversed with the arcing contacts 111-120-121 engaging first and the main contacts 110 and 115 closing later.

Figure 10:
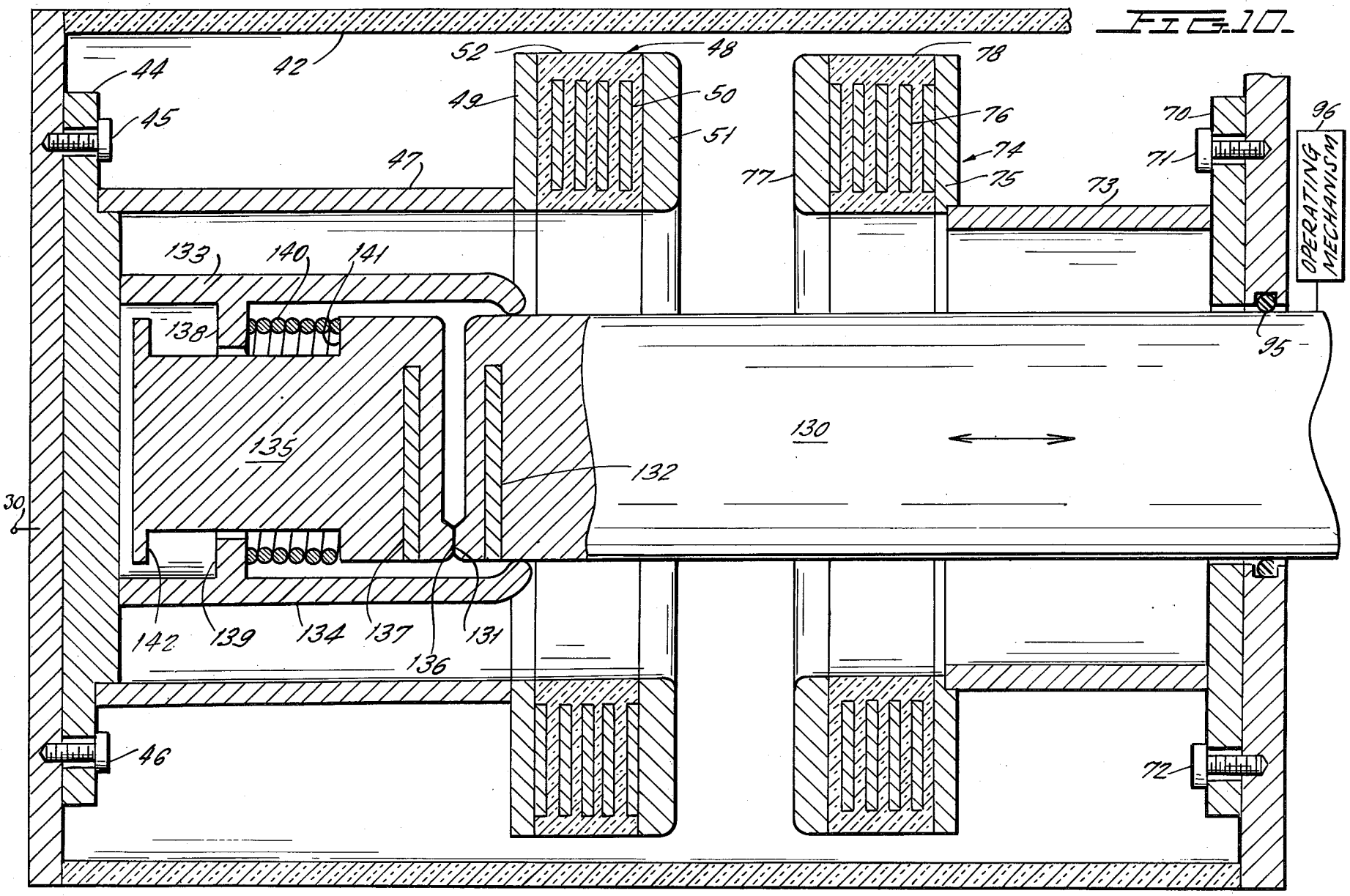
FIG. 10 is a longitudinal cross-sectional view of still another embodiment of the invention which employs a contact configuration having an increased magnetic blow-off effect for ensuring transfer of the arc to the arcing rings.

FIG. 10 shows another embodiment of the invention wherein the contact configuration is again changed and wherein components identical to those of FIGS. 3 to 9 have been given identical identifying numerals.

In FIG. 10, the main movable contact is an elongated rod 130 which is terminated by a raised end surface portion 131. The contact 130 is of a highly conductive material, such as copper, and a flush resistive insert 132 is fitted across the end of the contact in order to define a relatively low-resistance U-shaped current path at the contact end.

A main stationary contact is formed by a cluster of contact fingers, such as contact fingers 133 and 134 which surround the contact 130 as illustrated. The main stationary contact finger cluster receives an axially movable interrupter contact plunger 135 which has an end configuration similar to that of contact 130 and includes a lower end protrusion 136 and resistive insert 137 as shown.

The individual fingers 133 and 134 of the main stationary contact are then provided with internal shoulders 138 and 139, respectively, which receive a compression spring 140 which presses against a shoulder 141 of plunger 135 to bias the plunger 135 to the engaged position shown relative to the contact 130.

In operation and when the contacts are in the position shown in FIG. 10, the main current flow is from terminal 30, through the main contact finger cluster including fingers 133 and 134 and into the main contact 130 to the right of resistive insert 132.

In order to interrupt the circuit, the contact 130 is moved to the right by the operating mechanism 96, with the plunger 135 following the movement of contact 130 under the influence of spring 140 until the extension 142 on plunger 135 engages shoulders or stops 138 and 139. At that time, the end of movable contact 130 has moved to the right of the ends of contact fingers 133 and 134 so that the main current commutates into a path which includes the contact fingers 133 and 134, plunger 135 (to the left of resistive insert 137), the abutting contact between projections 136 and 131 and the movable contact rod or shaft 130. Once plunger 135 can no longer move to the right, the continued movement of contact rod 130 causes the separation of the circuit at extensions 131 and 136 and an arc is drawn between the extensions.

A substantial blow-off force is applied to the arc because the current must take an exaggerated U-shaped path around the resistive inserts 137 and 132 and through extensions 131 and 136, thus leading to a blow-off force which transfers the arc from the arcing contact sections 136 and 131 to the arcing rings 51 and 77, thereby leading to interruption of the arc by its rotation through the dielectric gas filling the interior of the interrupter bottle.

The opposite sequence takes place in the closing of the contacts as will be apparent to those skilled in the art.

Figure 11:
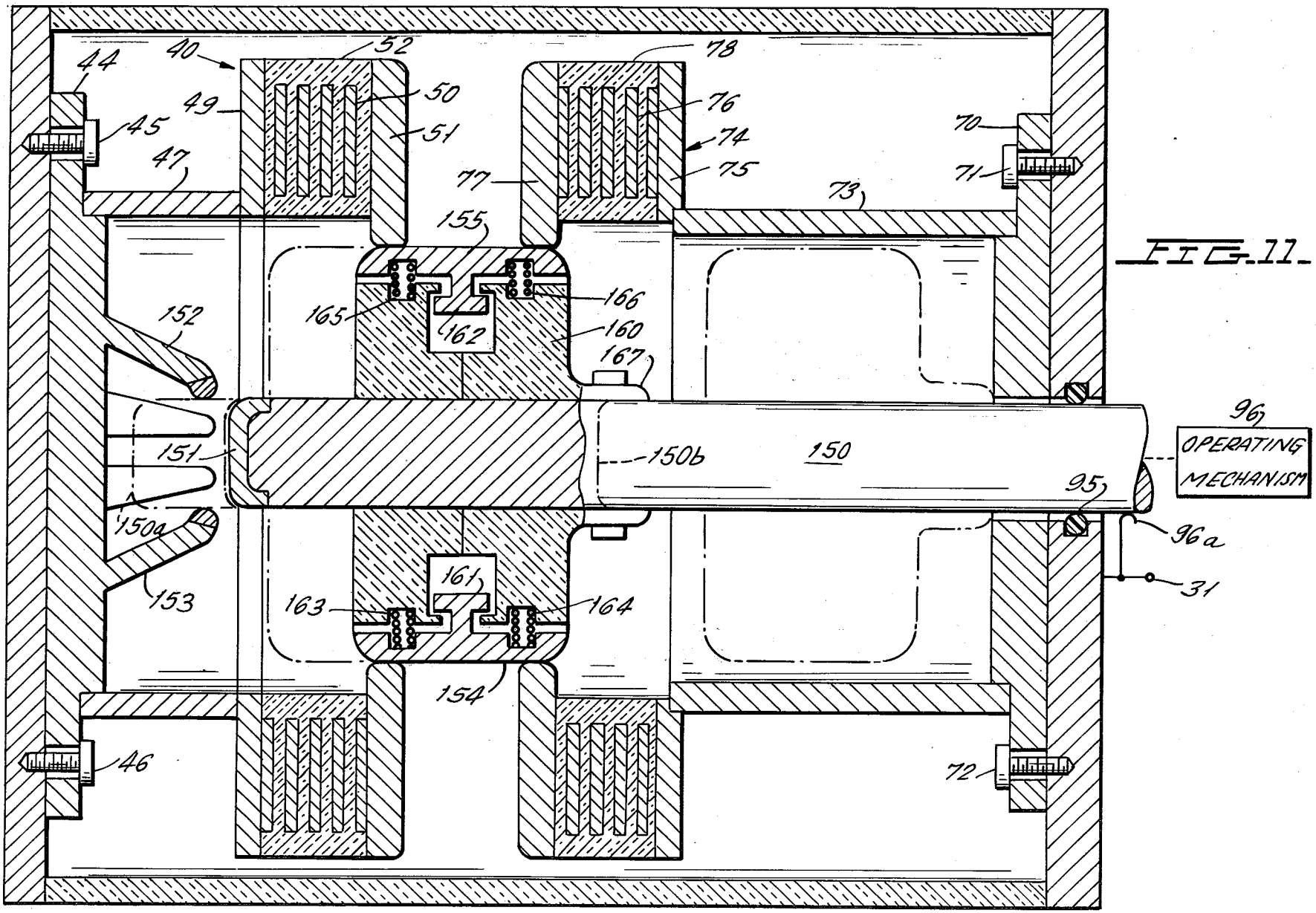
FIG. 11 is a longitudinal cross-sectional view of still a further embodiment of the invention wherein the arcing contacts form a temporary bridge connection across the spaced arcing rings during the movement of the contact of its open position.

FIG. 11 shows a still further embodiment of the invention where the contact configuration is again changed from that shown in FIGS. 3 to 10. In FIG. 11, components identical to those of FIGS. 3 to 10 have been given similar identifying numerals. Note, however, that the configuration of the arcing rings 51 and 77 has been changed in that the arcing contacts of FIG. 11 project radially inwardly from their position in the embodiment of FIGS. 3 to 10 for reasons to be described more fully hereinafter.

The movable contact structure in FIG. 11 consists of an elongated movable contact rod 150 which has an arcing contact tip 151 at the end thereof. Note that the movable contact 150 is shown in an intermediate operating position in the solid lines of FIG. 11 and that it would be in the dotted-line position 150*a* when fully closed and dotted-line position 150*b* when fully opened.

The movable contact 150 cooperates with a circular cluster of stationary contact fingers including fingers 152 and 153. The contact rod 150 also carries a circular ring of bridging contact elements including contact elements 154 and 155 which are capable of making sliding contact with the interior peripheries of arcing contact rings 51 and 77 as the contact 150 moves from the fully engaged position 150*a* to the fully disengaged position 150*b*.

The individual contact fingers 154 and 155 are supported within an insulation block 160 which may be formed of two halves which can be clamped together over T-shaped protrusions, such as protrusions 161 and 162 of the individual contact fingers, such as contact fingers 154 and 155.

A plurality of biasing springs including springs 163 and 164 for contact finger 154 and springs 165 and 166 for contact finger 155 press the contact finger outwardly so that they are biased toward engagement with the internal peripheries of contact rings 51 and 77. A suitable clamping arrangement is then provided which can include an extending neck 167 on insulation block 160 to permit it to be rigidly secured to the contact rod 150.

In operation, when the interrupter of FIG. 11 is closed, the contact rod 150 and the insulation housing 160 and the contact fingers connected thereto, such as fingers 154 and 155, are positioned to the left of the figure, shown in dotted-lines 150*a,* and there is disengagement between the contact fingers 154 and 155 and at least the contact ring 77.

In order to interrupt the circuit, the contact rod 150 is moved to the right and, in the course of movement, the bridging contact fingers, 154 and 155 make bridging contact between contact rings 51 and 77. Thus, when the movable contact tip 151 separates from the main stationary contacts 152 and 153, current commutates into the circuit including conductive cylinder 47, winding 50, contact ring 51, the bridging contacts 154 and 155, arcing ring 77, winding 76, conductive cylinder 73, sliding contact 96*a* and terminal 31.

As the contact 150 continues to move to the right, the sliding contacts 154 and 155 disengage from ring 51, drawing and arc which subsequently transfers to ring 77, and the arc between the rings 51 and 77 is then rotated rapidly through the gap between the rings and extinguished as described previously.

The bottle interrupter is closed by a sequence opposite to that described above.

Figures 12, 13:
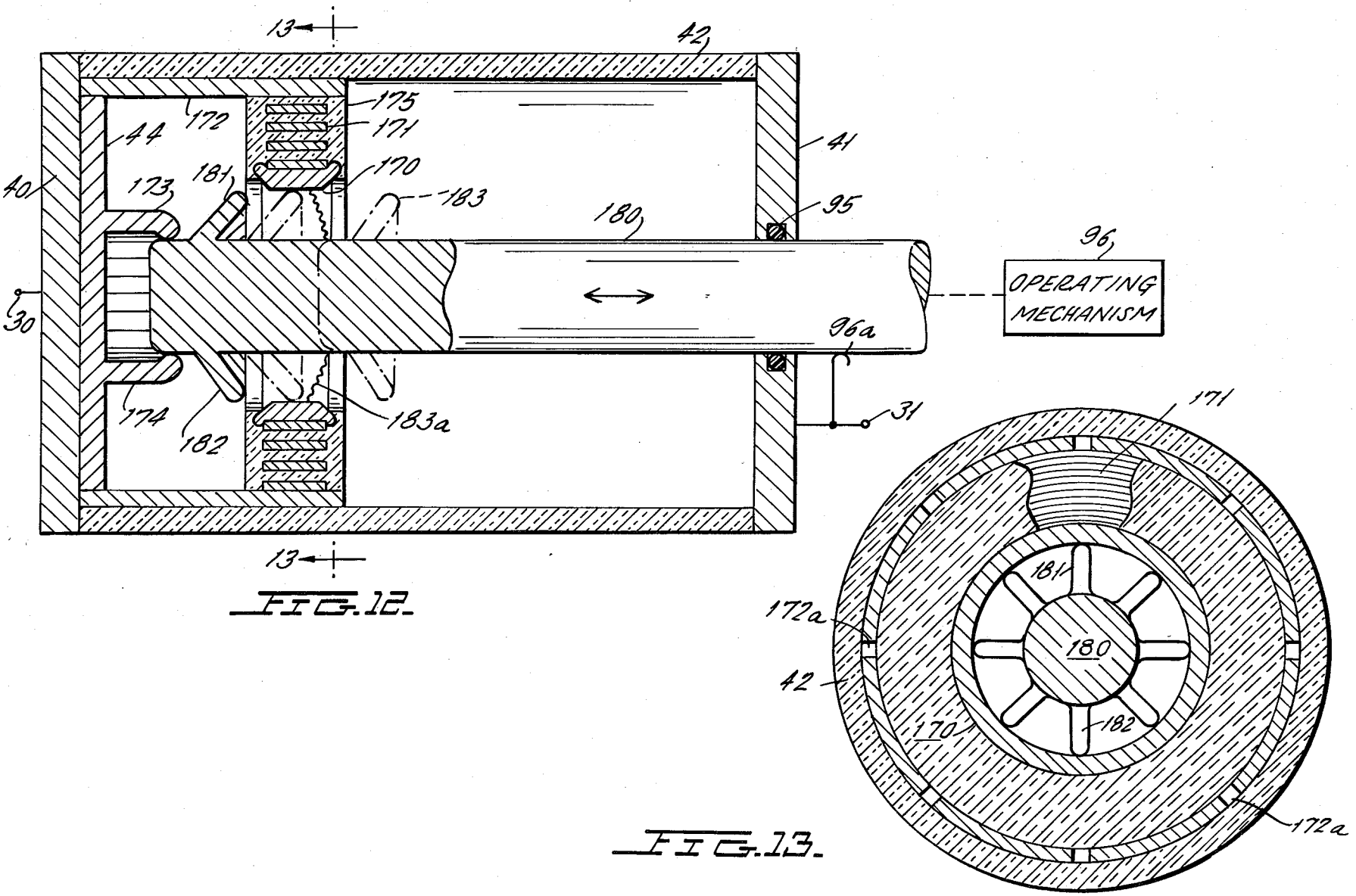
FIG. 12 is a longitudinal cross-sectional view of still another embodiment of the invention wherein a single winding and a single short-circuited ring are used in connection with a movable contact having contact fingers which temporarily engage the ring when the movable contact is opened.
FIG. 13 is a cross-sectional view of FIG. 12 taken across the section lines 13 — 13 in FIG. 12.

FIGS. 12 and 13 show a still further embodiment of the invention in longitudinal cross-sectional view wherein the main bottle components 40, 41 and 42 are utilized as in the prior embodiments. In the arrangement of FIGS. 12 and 13, however, only a single arcing ring is employed shown as the arcing ring 170 which is connected to one end of spiral winding 171. The other end of spiral winding 171 is then connected to conductive cylinder 172 which is, in turn, secured to and electrically connected to conductive pad 44 and conductive end plate 40 and terminal 30. Cylinder 172 is axially slotted as by slots 172*a* to prevent the forming of a short-circuited turn. The conductive member 44 also supports a stationary main contact formed of a cluster of inwardly biased contact fingers, such as fingers 173 and 174.

It should be noted that the arcing ring 170 is a continuous short-circuited ring of conductive material, such as copper, and the winding 171 connected to the ring 170 are housed in a common insulation housing 175 which can be of epoxytype material and adapted to withstand the exceptionally high forces of repulsion between winding 171 and ring 170 during the operation of the device.

The movable contact of FIGS. 12 and 13 consists of a movable contact rod 180 connected to a suitable operating mechanism 96 where the contact rod 180 has relatively flexible contact fingers, such as contact fingers 181 and 182 projecting therefrom. The extending fingers 181 and 182 are dimensioned to make wiping engagement with respect to the interior surface of short-circuited ring 170 during the movement of the contact rod 180 to the disengaged position shown by dotted lines 183 in FIG. 12.

In operation, when the breaker is closed, a current path is formed from terminal 30 into the main stationary contact fingers 173 and 174 and into the main contact end of shaft 180 and thence through the movable contact shaft 180 to the terminal 31. During interruption operation, contact rod 180 is moved to the right and the contact fingers 181 and 182 on the movable contact shaft 180 engage the interior surface of ring 170 just before the main contacts part at contact fingers 173 and 174. Continued motion of the contact shaft 180 to the right opens the contact at main contact fingers 173 and 174 and the current commutates into the path including conductive member 172, winding 171, ring 170, contact fingers such as contact fingers 181 and 182 and through the contact shaft 180 to terminal 31.

The current flow in winding 171 will now induce a strong circulating current in the short-circuited turn 170 and these two currents together create a concentrated magnetic field within the interior of conductive ring 170 which will have a substantial magnitude even while the current between terminals 30 and 31 is decreasing toward zero. When the contacts 181 and 182 continue to move to the right of ring 170 and part from the ring 170, the arc drawn between the contacts 181 and 182 and the ring 170 will be transferred from the fingers 181 and 182 to the outer periphery of contact shaft 180 to the left of the fingers in position 183, shown by arc 183*a.* The arc will then rotate very rapidly through the dielectric gas which fills the interior of the bottle, thereby leading to effective interruption of the arc and of the circuit connected to terminals 30 and 31.

Figure 14:
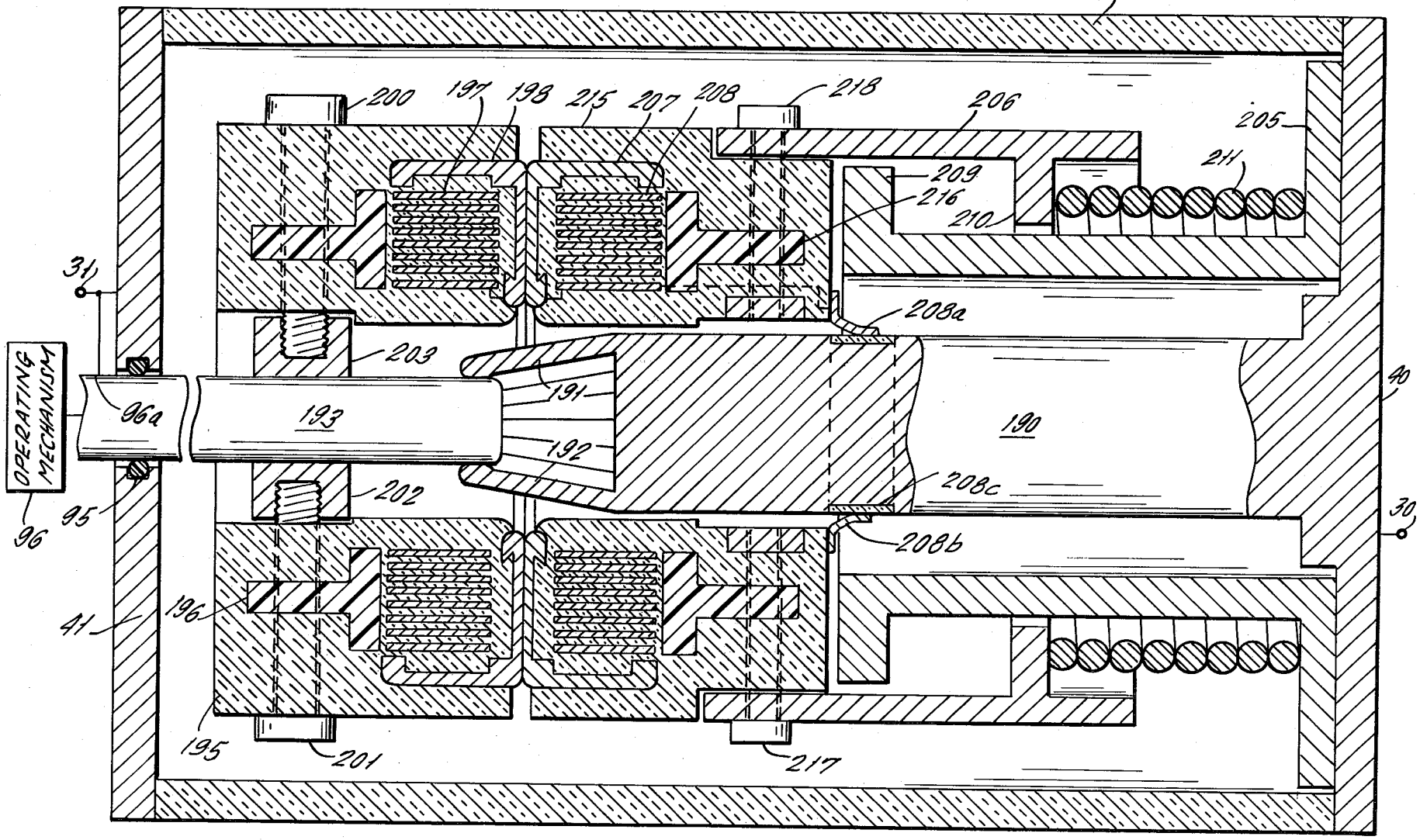
FIG. 14 is a longitudinal cross-sectional view of still another embodiment of the invention wherein the arcing rings are cooperable with one another and serve as arcing contacts for the contact configuration.

FIG. 14 is a longitudinal section of still another embodiment of the invention wherein the short-circuited rings serve as interrupter contacts as well as the ultimate fixed gap in which the arc is rotated to extinguish the arc. In FIG. 14, components identical to those of the arrangements of FIGS. 3 to 13 have been given similar identifying numerals. However, the contact configuration and the configuration of the arcing rings and windings in series therewith are modified from that shown in the above embodiments of the invention.

In FIG. 14 the main stationary contact consists of a contact rod 190 which is electrically and mechanically fixed to the conductive plate 40 and is terminated at its outer end by a cluster of fixed contact fingers including contact fingers 191 and 192. The main movable contact consists of a contact rod 193 which has a contacting end which engages the contact fingers 191 and 192 with high-pressure engagement when the interrupter is closed. The movable contact shaft 193 further carries an assembly including an insulation support housing 195 which may be of an epoxy. Housing 195 has a glass-polyester ring 196 embedded therein which is T-shaped in cross-section to provide additional mechanical strength for the insulation housing 195. The insulation housing 195 also has embedded therein a conductive winding 197 and a short-circuited ring 198 which is L-shaped in cross-section and which is closely coupled to winding 197. One end of winding 197 is electrically connected to ring 198 and the other end of winding 197 is electrically connected to the movable contact rod 193 by internal conductors which are not shown.

A suitable bolt arrangement including bolts 200 and 201 are used to bolt the ring-shaped assembly including winding 197 and shorted ring 198 to bosses 202 and 203 on the contact shaft 193.

In FIG. 14, a steel bracket 205 is mechanically fixed to plate 40 and serves as a support for slidably receiving axially movable sleeve 206. Sleeve 206 is fixed to an assembly of a second short-circuited ring 207 and winding 208 connected thereto. One end of winding 208 is connected to ring 207, and its other end is connected to sliding contacts **208*a* and 208*b* which are secured to housing 215 and slide on shaft 190. Note that an insulation ring 208*c* prevents engagement of contacts 208*a* and 208*b* with shaft 190, while the interrupter is in the position shown in FIG. 14 to prevent current flow in coils 197 and 208 when the interrupter is closed. The sleeve 206 is fitted over the outer extension 209 of member 205 and has and internal shoulder 210 which receives one end of a compression spring 211 which tends to bias sleeve 206 to the left in FIG. 14. The short-circuited ring 207 and winding 208 are substantially identical to the ring 198 and winding 197 and are potted in an insulation housing 215 which is substantially identical to housing 195. A glass-polyester insert 216 is carried within the housing 215 for additional mechanical support and, as was the case for the housing 195, a plurality of bolts including bolts 217 and 218 pass through a portion of the T-shaped reinforcing member 216 and secure the housing 215 to the end of sleeve 206.**

The opposing surfaces of shorted rings 198 and 207 serve the purpose of the interrupter contacts and, as will be seen, also serve as the fixed spaced gap in which an arc is rotated through the gas filling the housing 42 to extinguish the arc.

When the interrupter is in the closed position of FIG. 14, a current path is established from movable contact shaft 195 directly into contact fingers 191 and 192 on stationary contact shaft 190. There is a parallel path for current flow which includes contact shaft 193, winding 197 and contact 198.

In order to open the interrupter of FIG. 14, the operating mechanism moves the movable contact shaft 193 to the left, whereupon the housing 195 and all of the components contained therein move to the left so that the end of movable contact rod 193 separates from the fixed contact fingers 191 and 192. The conductive ring 207, however, stays in engagement with the conductive ring 198 since the housing 215 follows the motion of housing 195 to the left under the influence of spring 216 and contacts **208*a* and 208*b* engage the conductive surface of shaft 190 to the left of insulation insert 208*c*. Thus, current commutates from the main contact path and into the circuit which includes movable contact shaft 193, winding 197, conductive ring 198, conductive ring 207, winding 208 and stationary shaft 190.**

Once the movable contact rod 193 has moved far enough to the left that shoulder 210 engages shoulder 209, the housing 215 remains stationary while the housing 195 continues to move to the left until a fixed gap of about ½ inch is reached, at which time the housing 195 and the movable shaft 193 stop their motion. During this time, the conductive rings 198 and 207 separate and an arc is drawn between them. This arc, however, is exposed to the combined effects of the magnetic fields in winding 197 and 208 and of the circulating current in short-circuited windings 198 and 207 so that the arc is rapidly rotated through the dielectric gas in the gap formed between rings 198 and 207 and then extinguished as previously described. The gap in the gap can be sulfur hexafluoride under about 15 p.s.i.g.

It should be noted that the arrangement shown in connection with FIG. 14 utilizes a lost motion connection between housing 215 and the stationary contact rod 190. If desired, the support structure for ring 207 and winding 208 could be stationary and a lost motion configuration could have been placed between the movable contact rod 193 and the housing 195. Thus, the contact motion in such an arrangement could be initiated without having to move the additional mass of housing 195 and its associated components, but these components could be moved with a snap action once a sufficient separation is obtained between contact rod 193 and the fixed contact fingers 191 and 192.

Although the present invention has been described with respect to its preferred embodiments, it should be understood that many variations and modifications will now be obvious to those skilled in the art, and it is preferred, therefore, that the scope of the invention be limited not by the specific disclosure herein, but only by the appended claims.

The embodiments of the invention in which an exclusive privilege or property is claimed are defined as follows:

1. A circuit interrupter comprising an elongated cylindrical housing filled with dielectric gas at a single pressure, first and second cooperable conductive rings operable to define an arcing gap between their opposing surfaces and composed of high conductivity material, and an electrical winding closely magnetically coupled to said first conductive ring; said first conductive ring defining a short-circuited turn; said electrical winding being operable with said first conductive ring to produce a magnetic field which is out of phase with the arc current to be interrupted by said circuit interrupter for rapidly spinning an arc around said arcing gap even near instantaneous current zero, first and second terminals fixed to said circuit interrupter; said first terminal, said winding, said first conductive ring, said second conductive ring and said second terminal being connected in electrical series; said first and second conductive rings and said winding being coaxial with the axis of said cylindrical housing; first and second interrupter contacts connected to said first and second terminals respectively and relatively movable parallel to the said axis of said cylindrical housing between an open and a closed position; said first conductive ring and said electrical winding having internal diameters; said first and second interrupter contacts being concentrically disposed within the interior of said internal diameters of said first conductive ring and said electrical winding; said first and second interrupter contacts engaging in a region axially aligned with said arcing gap.

2. The circuit interrupter of claim 1 wherein said first and second interrupter contacts define a current path having a reentrant section having legs which are transverse to said axis of said housing at a region adjacent said arcing gap, whereby a magnetic blow-off force is created to move an arc between said first and second contacts into said arcing gap.

3. The circuit interrupter of claim 1 which further includes a first and a second main contact connected to said first and second terminals respectively; said first and second main contacts being axially movable relative to one another; and means connecting said first and second main contacts to said first and second interrupter contacts, whereby said first and second main contacts are the first to open and last to close relative to said interrupter contacts.

4. The circuit interrupter of claim 1 which further includes a second winding connected between said second conductive ring and said second terminal; said second winding being closely coupled to said second conductive ring and being coaxial with said axis of said housing.

5. The circuit interrupter of claim 1 wherein said first ring and said winding are rigidly immersed in a common potted insulation ring, thereby to be rigidly supported against electrodynamic forces of repulsion between said closely coupled first ring and winding.

6. The circuit interrupter of claim 1 wherein said dielectric gas consists of sulfur hexafluoride under pressure.

7. The circuit interrupter of claim 4 wherein said first and second rings and said winding and second winding, respectively, are rigidly immersed in respective first and second potted insulation rings, thereby to be rigidly supported against electrodynamic forces of repulsion between said closely spaced rings and windings.

8. The circuit interrupter of claim 7 wherein said dielectric gas consists of sulfur hexafluoride under pressure.

9. The circuit interrupter of claim 3 wherein said first and second interrupter contacts define a current path having a reentrant section having legs which are transverse to said axis of said housing at a region adjacent said arcing gap, whereby a magnetic blow-off force is created to move an arc between said first and second contacts into said arcing gap; said second interrupter contact comprising a laterally extending portion of the end of said second main contact.

10. The circuit interrupter of claim 2 wherein said first and second interrupter contacts comprise axially disposed tubular conductors having generally flat opposing end surfaces; each of said opposing end surfaces having off-axis projecting contact surfaces movable into and out of engagement with respect to one another; and flat high-resistance inserts disposed parallel to said flat opposing end surfaces and spaced therefrom and aligned with said projecting contact surfaces to define said reentrant current section through said interrupter contacts to cause a magnetic blow-out force on an arc drawn between said projecting contact surfaces.

11. The circuit interrupter of claim 2 which further includes a first and a second main contact connected to said first and second terminals respectively; said first and second main contacts being axially movable relative to one another; and means connecting said first and second main contacts to said first and second interrupter contacts, whereby said first and second main contacts are the first to open and last to close relative to said interrupter contacts; said first interrupter contact comprising the interior surface of said first conductive ring; said second interrupter contact comprising a bridging contact axially movable into bridging contact engagement with the interior surfaces of said first and second conductive rings to a position at which said bridging contact disengages at least said first conductive ring.

12. The circuit interrupter of claim 2 which further includes a first and a second main contact connected to said first and second terminals respectively; said first and second main contacts being axially movable relative to one another; and means connecting said first and second main contacts to said first and second interrupter contacts, whereby said first and second main contacts are the first to open and last to close relative to said interrupter contacts; said first conductive ring and said first winding being connected to said first main contact and being movement therewith for at least a portion of the movable of said first main contact to a disengaged position with respect to said second main contact; said first and second conductive rings having portions thereof defining said first and second interrupter contacts respectively.

13. A circuit interrupter comprising a sealed housing filled with a static dielectric gas at a single pressure greater than atmospheric pressure, a first ring of relatively high conductivity material disposed within said housing and serving as a short-circuited winding and as the first of a pair of cooperable interrupter contacts; a second and ring-shaped interrupter contact which is coaxial with and longitudinally movable along the axis of said first ring and which is movable into and out of engagement with said first ring; an electrical winding closely magnetically coupled to said first ring and wound about the axis of said first ring; first and second terminals for said circuit interrupter; said first terminal, said winding, said first ring, said second interrupter contact and said second terminal being connected in electrical series when said second interrupter contact engages said first ring; and a pair of cooperable main contacts connected to said first and second terminals respectively and operated relative to said first and second interrupter contacts, whereby said main contacts are opened before said interrupter contacts are opened; said electrical winding inducing a high circulating current in said first ring when current flows in said electrical winding; said current in said electrical winding and said circulating current in said ring producing a magnetic field which passes through the arc current drawn between said first ring and said second interrupter contact and which is phase-shifted from the arc current, thereby to cause said arc current to rapidly rotate through the static dielectric gas which is between said first ring and said second interrupter contact, even at low instantaneous arc current values, whereby the relative movement between said static dielectric gas and said arc current assists in the extinction of said arc current.

14. The circuit interrupter of claim 13 wherein both said first ring and said electrical winding are rigidly immersed in a common potted insulation ring, thereby to be rigidly supported against electrodynamic forces of repulsion between said closely coupled first ring and electrical winding.

15. The circuit interrupter of claim 14 wherein said dielectric gas consists of sulfur hexafluoride under pressure.

16. The circuit interrupter of claim 13 wherein said electrical winding consists of a flat conductor wound in spiral form.

17. The circuit interrupter of claim 14 wherein said electrical winding consists of a flat conductor wound in spiral form.

* * * * *